US008734119B2

(12) United States Patent
Le et al.

(10) Patent No.: US 8,734,119 B2
(45) Date of Patent: May 27, 2014

(54) ADVANCED FREQUENCY VARIABLE PUMP SPEED CONTROLLER AND METHOD OF OPERATING

(75) Inventors: Kevin Le, Richland Hills, TX (US); Sivakumar Parameswaran, Irving, TX (US); Thanh Le, Grand Prairie, TX (US)

(73) Assignee: Luraco Technologies, Inc., Arlington, TX (US)

( * ) Notice: Subject to any disclaimer, the term of this patent is extended or adjusted under 35 U.S.C. 154(b) by 250 days.

(21) Appl. No.: 13/153,448

(22) Filed: Jun. 5, 2011

(65) Prior Publication Data

US 2012/0308402 A1 Dec. 6, 2012

(51) Int. Cl.
*F04B 19/00* (2006.01)

(52) U.S. Cl.
USPC ..... 417/44.1; 417/426; 210/167.12

(58) Field of Classification Search
USPC ..... 417/44.1, 45, 426; 210/167.1, 167.12
See application file for complete search history.

(56) References Cited

U.S. PATENT DOCUMENTS 8,043,070 B2 * 10/2011 Stiles et al. ..... 417/44.1
2007/0154323 A1 * 7/2007 Stiles et al. ..... 417/44.1

* cited by examiner

*Primary Examiner* — Charles Freay
*Assistant Examiner* — Patrick Hamo
(74) *Attorney, Agent, or Firm* — Haynes and Boone, LLP

(57) ABSTRACT

The invention is an apparatus and method of varying power output and decrease noise generation of spa pumps by powering them with a variable frequency power device, digital signals capable of controlling cascaded pumps using ganged controls, and to decrease safety concerns of spas using an integrated water level and motion detectors.

8 Claims, 3 Drawing Sheets

FIGURE 1
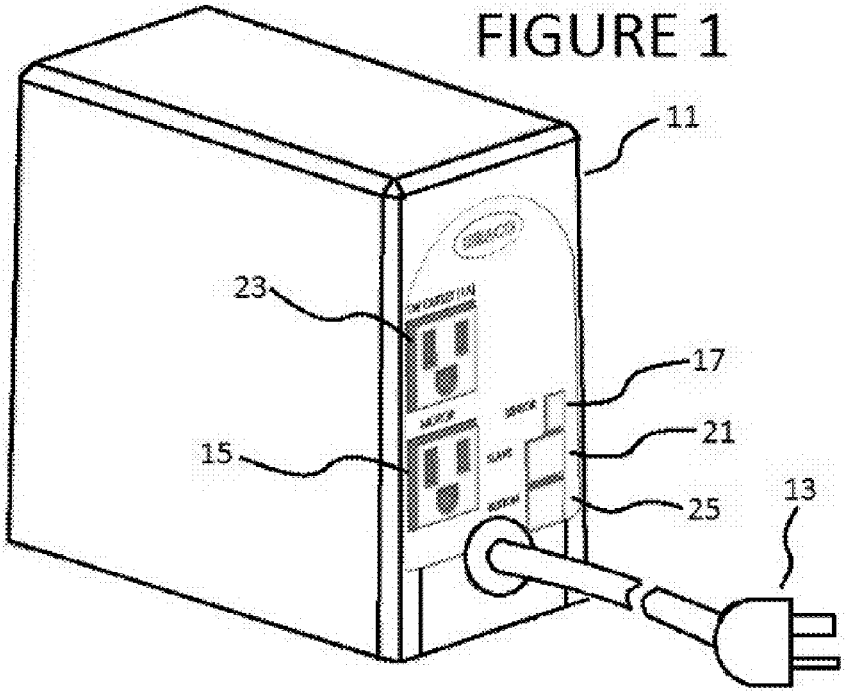
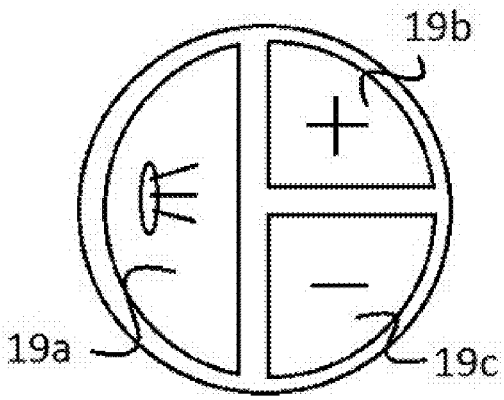
19
FIGURE 1a

ADVANCED FREQUENCY VARIABLE PUMP SPEED CONTROLLER AND METHOD OF OPERATING

CROSS-REFERENCE TO RELATED APPLICATIONS

None

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE OF THE MATERIAL ON THE COMPACT DISC

Not Applicable.

BACKGROUND OF THE INVENTION (1) Field of the Invention

The invention involves control of a spa's water speed, particularly a method of controlling water pump rotational speed using variable frequency control, rather than a water restriction valve or separate motor windings, which increases overall spa efficiency, decreases audible noise, simplifying installation costs, and allowing for a single set of controls to operate several tubs which are ganged together.

(2) Description of the Related Art Including Information Disclosed Under 37 CFR 1.97 and 1.98

Spas have electric motors sized from 0.5 hp to 5 hp to circulate water though a closed system. One motor is usually used in smaller spas, but multiple motors can be used on larger models. Control of water flow through the system is commonly accomplished by one of two methods.

The first method is to employ a diverter valve, placing it in the water line to the spa, which restricts the water flow, stemming the force from the pump to one zone of the tub or another, or to restrict the flow in a significant fashion. This approach requires a cut in the pipe between the pump exit port to the tub, and the insertion of the valve, so water flow to the tub is diverted or severely restricted. In this approach, the motor continues to use the same amount of energy, irrespective of the work it is doing, whether the water flow is 10% of its capabilities, or 100%.

The second method is to use multi-speed motors that have at least two sets of windings. A designer of spas can use one set of windings for one speed, but by energizing the other or both windings, the motor doubles its speed, and thus the force by which it moves the water. This approach has only two speeds, and requires a motor built for the purpose of operating with only half of its windings energized. By definition this is an inefficient motor construction, and requires a motor that is more expensive than a more traditional motor with one set of windings.

The third method is to use a triode alternating current switch, or triac connected in series with the motor. A triac is a small semiconductor device, similar to a transistor, made of different layers of semiconductor materials. By controlling the voltage applying to the gate of triac, energy flowing to the motor can be reduced. As a result, motor speed can be controlled. However, this technology has a serious issue that burns or cut the motor life short. This issue is due to the fundamental nature of the motor. It has been known that efficiency of induction AC motor is a function of voltage. Therefore, when voltage drops, motor efficiency also drops. As a result, heat will be generated. The more voltage drops the more heat will be generated. Excessive heat can damage the motor coil insulation resulting in a short circuit or motor damage.

Several means of controlling the pump speed exist. For some configurations, air switches are used to actuate a switch or relay. For others, a hand-operated dial switch is used to complete electrical circuit. The struggle with these approaches leaves commercial installations at the mercy of users who often make pump settings without authorization of the establishment managers, or leave the pump in a position of full-speed operation though no individual is in the tub, wasting enormous amounts of power.

What is needed is a simple means to securely control pump speed without cutting into the piping between the pump and tub, using inexpensive one-winding motors, using a means of control that reduces noise and increases efficiency when not operating at full speed, and to control multiple motors and tubs at one time in a secure manner, such that commercial operators can set tub jet pressure remotely and without fear of their clients changing the settings.

While this document uses the word "spa" throughout, it will be understood by those skilled in the art that this invention is equally applicable to any water jet-equipped tub appliance, such as hot tubs, Jacuzzis, and whirlpools.

BRIEF SUMMARY OF THE INVENTION

The general object of the invention is to use a one-piece, digital, variable speed control (VSC) module, this module containing an AC variable frequency converter to operate a pump motor efficiently at a speed that is lower than the motor's 60 Hz design speed. The VSC module can provide a pulsating jet action or a constant pressure action. Along with this control, the VSC module has a jack to communicate with other like units, with one unit acting as master to the other slave units. The VSC module could also have digital control communications for water level sensors and lighting controls.

BRIEF DESCRIPTION OF THE SEVERAL VIEWS OF THE DRAWING

The attached drawings are provided as a non-limiting example of the invention, specifically:

FIG. 1 depicts an orthogonal view of the invention.

FIG. 1*a* is one embodiment of the control button as currently configured.

DETAILED DESCRIPTION OF THE INVENTION

Figure 2:
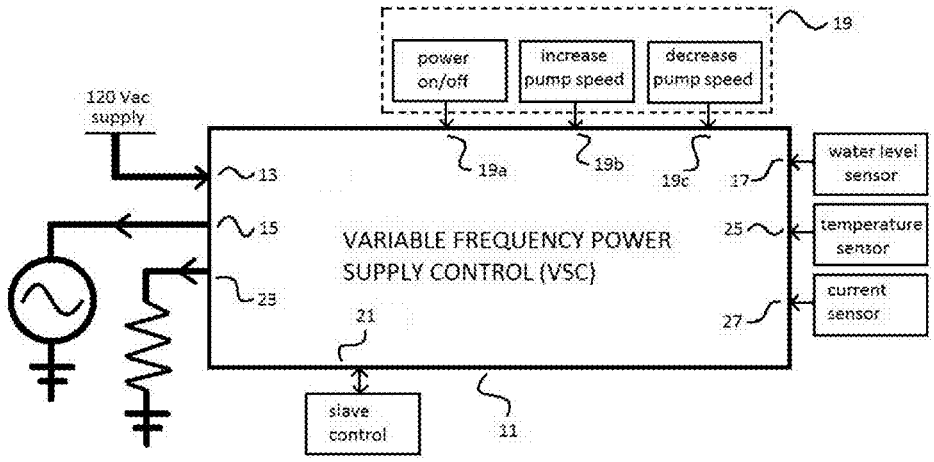
FIG. 2 is a diagrammatic representation of an embodiment of the control system.

As typified in FIG. 1, the foregoing and other objects and advantages are attained by a VSC module 11 that receives power from a standard 50/60 Hz, nominal AC wall outlet 13, and delivers power to the spa pump motor through a AC power outlet 15 in the VSC module chassis, after first converting the frequency of the power to change the speed of the motor to reflect an operator's desired speed, which he sets using a control button interface 19, said button interface connecting by wire to a portal on the chassis 25. Input from a water level sensor 17 ensures safe and efficient pump motor operation by stopping operation if no water is present in the tub. The unit has an auxiliary power outlet 23 that is controlled by the control button interface 19. The VSC module is designed to be ganged together using a slave control connection 21 so one setting can operate a number of pump motors that might power a large spa with many pumps, or a string of individual spas.

FIG. 1*a* shows the control button 19 as currently configured. This button allows an operator to send the VSC module three different signals, including the main power signal 19*a*, used to turn the main spa jets and auxiliary power off and on, the signal to increase pump speed 19*b*, and the signal to decrease pump speed 19*c*.

The button can be mounted on a wall, spa tub, or wherever convenient. When a user presses the On/Off button 19*a* once, the spa jets and auxiliary power are energized. When it is pressed a second time, the jets turn off. A third time turns the auxiliary power off. An operator can send the signal to pulsate by pressing both the "+" (increase speed) button 19*b* and the "–" (decrease speed) 19*c* at the same time. To cease the pulsate function, an operator presses either the "+" (increase speed) 19*b* or the "–" button (decrease speed) 19*c*.

In typical usage, the auxiliary power plug 23 will provide power to the spa tank lighting, but nothing prevents an operator from using this plug for a sound system or other electronic device.

FIG. 2 is a diagrammatic representation of an embodiment of the control system as it is currently implemented. The control button interface 19 has three different signals, including the main power signal 19*a*, used to turn the main spa jets and auxiliary power off and on, the signal to increase pump speed 19*b*, and the signal to decrease pump speed 19*c*.

The slave control signal 21 is a two-way communications port to allow a master signal to either send or receive settings from another unit.

A VSC module 11 can relay its control signals through a slave port connection 21, leading to another module. In this manner, an administrator can set all the pumps in a commercial setting, or a user can set the same pump speed on two motors serving the same tub.

The VSC module 11 can include optional sensor inputs which disallow operation under unsafe conditions. These include a water level sensor 17, which informs the VSC module 11 of an insufficient water level, a temperature sensor 25 which indicates the temperature inside the VSC module is too high, and an overcurrent sensor 27 which indicates that the current through the motor windings is too high. If any of these sensors indicate unsafe conditions, the VSC module 11 will shut down the spa motor until such condition ceases.

Figure 3:
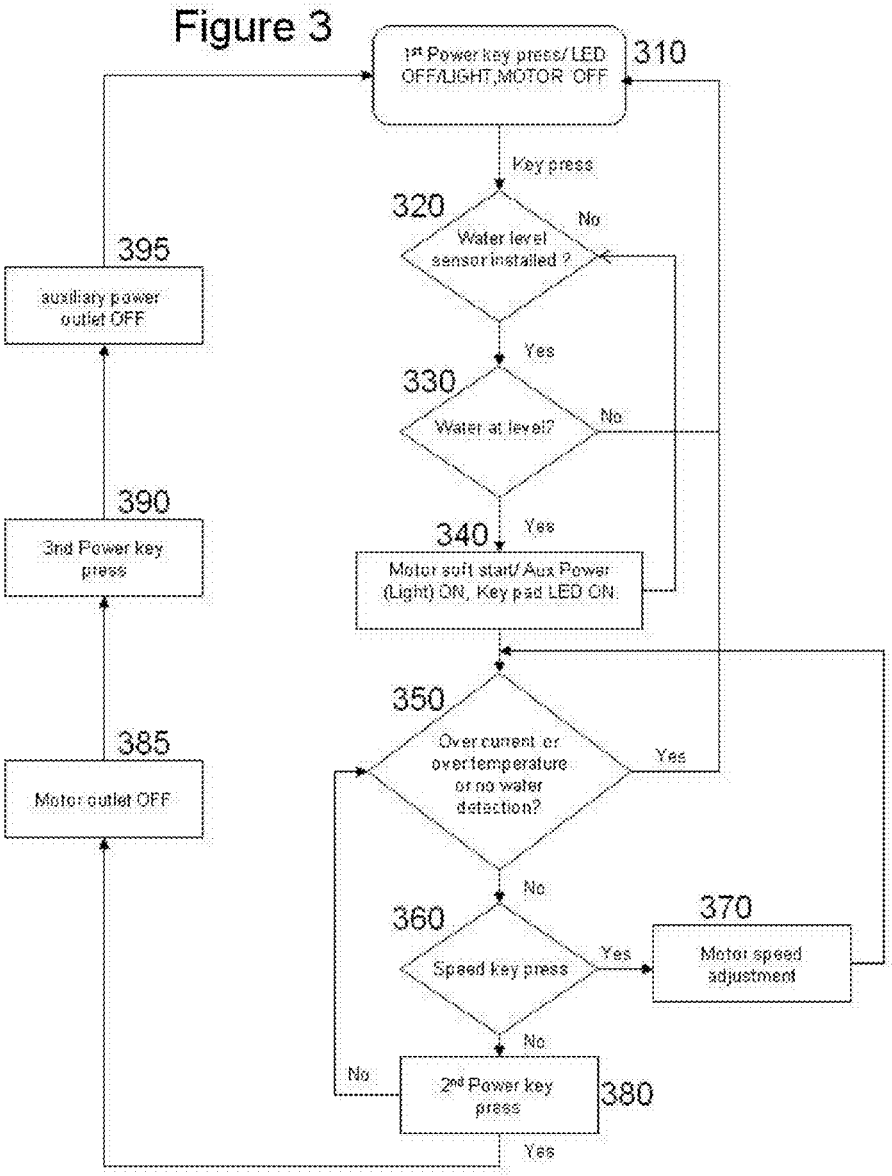
FIG. 3 depicts a method for spa operation using variable frequency control.

FIG. 3 is a flowchart of a method for normal operation of a spa using the VSC module 11 in accordance with an embodiment as described previously. The method 300 begins in block 310 when the user presses the On/Off button 19 for the first time in its cycle. In block 320, the VSC module 11 checks to see if a water level sensor is installed, and if so, block 330 of the logic checks to see there is sufficient water in the system to operate. If sufficient water is present, then in block 340, the motor is started and the auxiliary power is turned on, which is typically an external lighting circuit.

As noted in block 350, the VSC module 11 continuously checks for overcurrent conditions in the pump motor winding and water level. If either condition reaches a preset unacceptable threshold, the unit shuts down the power.

Block 360 and 370 shows that a user who wishes to change the water pressure of the spa jets presses the pump speed button control 19*b* to increase speed, or 19*c* to decrease the water pressure.

Block 380 and 385 show that the system shuts down the pump motor when the operator presses the power key 19*a* a second time. As blocks 380 and 350 show, the overcurrent and overtemperature monitoring continues when the operator is not pressing the power key 19*a* or speed keys 19*b* 19*c*.

Block 390 and 395 show that the system shuts down the auxiliary power when the operator presses the power key 19*a* a third time. At that point, the system is completely unpowered and awaits operator input to start the system again.

As the speed of a pump motor decreases, the audible noise created by the spa is decreased, as well as the energy use. This frequency variable technology is a decided advantage over current designs for varying the flow in a tub, which are limited to multi-speed based motor, or single-speed motor designs that use a restrictive valve, speed control using triac electronics, or other means to decrease the water speed, though the motor itself operates at a single speed.

While the preceding description discusses one embodiment, it will be understood by those skilled in the art that various changes in form and detail may be made without departing from the spirit and scope of the present disclosure. Though this application uses the word "spa" to discuss the invention, it is equally applicable to any water jet-equipped tub appliance, such as hot tubs, Jacuzzis, and whirlpools.

The invention claimed is:

1. A method comprising:

receiving at a variable speed controller a power supply voltage having a first frequency, wherein the variable speed controller is associated with a fluid pump motor that is operable to pump fluid into a basin through a fluid jet;

receiving at a controller interface associated with the variable speed controller a first selection of a first button;

after receiving at the controller interface associated with the variable speed controller the first selection of the first button, determining by the variable speed controller whether a fluid level sensor is present, wherein the fluid level sensor is operable to sense fluid level associated with the basin and the fluid pump motor;

after determining by the variable speed controller that the fluid level sensor is present, determining whether a fluid level associated with the basin and the fluid pump motor is equal to or greater than a predetermined level that is sufficient to operate the fluid pump motor;

after determining that the fluid level associated with the basin and the fluid pump motor is equal to or greater than the predetermined level, starting the fluid pump motor at a first speed such that fluid jet emits the fluid at a first fluid pressure;

after starting the fluid pump motor at the first speed such that fluid jet emits the fluid at the first fluid pressure, receiving at the controller interface associated with the variable speed controller a selection of a second button that is different than the first button;

after receiving at the controller interface associated with the variable speed controller the selection of the second button, converting by the variable speed controller the first frequency of the power supply voltage to a second frequency such that the fluid pump motor operates at a second speed and the fluid jet emits the fluid at a second fluid pressure, wherein the second frequency is different from the first frequency, wherein the second speed is different from the first speed, wherein the second fluid pressure is different from the first fluid pressure;

after converting by the variable speed controller the first frequency of the power supply voltage to the second frequency, receiving at the controller interface associated with the variable speed controller a selection of a third button that is different than the first and second buttons;

after receiving at the controller interface associated with the variable speed controller the selection of the third button, converting by the variable speed controller the second frequency of the power supply voltage to a third frequency such that the fluid pump motor operates at a third speed and the fluid jet emits the fluid at a third fluid pressure, wherein the third frequency is different from the first and second frequencies, wherein the third speed is different from the first and second speeds, wherein the third fluid pressure is different from the first and second fluid pressures; and after converting by the variable speed controller the second frequency of the power supply voltage to the third frequency, receiving at the controller interface associated with the variable speed controller a second selection of the first button such that variable speed control shuts down operation of the fluid pump motor in response to the second selection of the first button.

2. The method of claim 1, further comprising:

determining by the variable speed controller whether a temperature of the variable speed controller is equal to or greater than a temperature threshold; and shutting down operation of the fluid pump motor when the variable speed controller determines that the temperature of the variable speed controller is equal to or greater than the temperature threshold.

3. The method of claim 1, further comprising:

determining by the variable speed controller whether a current through motor windings associated with the fluid pump motor is equal to or greater than a current threshold; and shutting down operation of the fluid pump motor when the variable speed controller determines that the current through motor windings associated with the fluid pump motor is equal to or greater than the current threshold.

4. The method of claim 1, further comprising after converting by the variable speed controller the first frequency of the power supply voltage to the second frequency, receiving by the controller interface a simultaneous selection of the second and third buttons such that variable speed control causes the fluid emitted by the fluid jet to pulsate.

5. The method of claim 1, further comprising after receiving at the controller interface associated with the variable speed controller the first selection of the first button, powering on an auxiliary power port associated with the variable speed controller; and after receiving at the controller interface associated with the variable speed controller the second selection of the first button, receiving at the controller interface associated with the variable speed controller a third selection of the first button such that variable speed control powers off the auxiliary power port in response to the third selection of the first button.

6. The method of claim 1, further comprising receiving at another variable speed controller the power supply voltage having the first frequency, wherein the another variable speed controller is associated with another fluid pump motor that is operable to pump fluid into another basin through another fluid jet, and wherein converting by the variable speed controller the first frequency of the power supply voltage to the second frequency such that the fluid pump motor operates at the second speed and the fluid jet emits the fluid at the second fluid pressure includes sending by the variable speed controller a signal to the another variable speed controller communicatively coupled to the variable speed controller that causes the another variable speed controller to convert the first frequency of the power supply voltage to the second frequency such that the another fluid pump motor operates at the second speed and the another fluid jet emits the fluid at the second fluid pressure into the another basin.

7. The method of claim 1, wherein the second frequency is less than the first frequency, wherein the third frequency is greater than the second frequency, and and wherein the third frequency is less than the first frequency.

8. The method of claim 1, wherein the first button is a power button, wherein the second button is a decrease speed button, and wherein the third button is an increase speed button.

* * * * *